United States Patent [19]

Weber et al.

[11] Patent Number: 4,693,180

[45] Date of Patent: Sep. 15, 1987

[54] IMPACT DETONATOR WITH A DETONATOR CAP

[75] Inventors: Adolf Weber, Neunkirchen; Hans Strauss, Reichenschwand; Adolf Bankel, Uttenreuth/Weiher, all of Fed. Rep. of Germany

[73] Assignee: Diehl GmbH & Co., Nuremberg, Fed. Rep. of Germany

[21] Appl. No.: 908,373

[22] Filed: Sep. 17, 1986

[30] Foreign Application Priority Data

Oct. 8, 1985 [DE] Fed. Rep. of Germany ..... 3535854

[51] Int. Cl.[4] ..... F42C 1/02; F42C 1/08; F42C 9/04; F42C 15/22

[52] U.S. Cl. ..... 102/274; 102/265; 102/268

[58] Field of Search ..... 102/272, 273, 274, 265, 102/266, 268, 238, 239, 242, 253

[56] References Cited

U.S. PATENT DOCUMENTS

| | | | |
|---|---|---|---|
| 2,376,332 | 5/1945 | Adelman | 102/274 |
| 2,513,536 | 7/1950 | Wellington | 102/272 X |
| 2,701,527 | 2/1955 | Granath et al. | 102/242 |
| 3,638,501 | 2/1972 | Prachar | 102/272 X |
| 3,995,557 | 12/1976 | Engel et al. | 102/273 X |
| 4,440,085 | 4/1984 | Rossmann et al. | 102/274 X |

FOREIGN PATENT DOCUMENTS

| | | | |
|---|---|---|---|
| 1185093 | 1/1965 | Fed. Rep. of Germany . | |
| 1206761 | 12/1965 | Fed. Rep. of Germany . | |
| 579672 | 10/1924 | France | 102/274 |
| 297056 | 5/1954 | Switzerland | 102/274 |

*Primary Examiner*—David H. Brown

*Attorney, Agent, or Firm*—Scully, Scott, Murphy & Presser

[57] ABSTRACT

An impact or percussion detonator including a detonator cap which is piercable by a striker or firing pin actuated by a spring force from the rear end of the detonator, including a mechanical retarding or delay arrangement incorporating blocking members which, in their blocking position are located, on the one side, in recesses provided in the striker and on the other side, in recesses provided in a detonator component. The detonator component is constituted of an axially movable securing sleeve, and a recess which receives the blocking members is provided a base member fastened to a housing of the detonator at a distance in the direction towards detonating.

7 Claims, 2 Drawing Figures

IMPACT DETONATOR WITH A DETONATOR CAP

BACKGROUND OF THE INVENTION

1. Field of the Invention

The present invention relates to an impact or percussion detonator including a detonator cap which is piercable by a striker or firing pin actuated by a spring force from the rear end of the detonator, including a mechanical retarding or delay arrangement incorporating blocking members which, in their blocking position, are located, on the one side, in recesses provided in the striker, and on the other side, in recesses provided in a detonator component.

2. Discussion of the Prior Art

From the disclosure of German Patent No. 28 42 882 there has become known an impact or percussion detonator with a detonator cap which can be pierced from the rear end of the detonator through the intermediary of a striker or firing pin which is actuated by a spring force. Furthermore, the impact detonator includes a mechanical retarding or delay arrangement including blocking members which, in their blocking position, are located, on one side thereof, in recesses provided in the striker, and on the other side, in recesses provided in a stationary detonator component. Finally, two sequential inertial sleeves are coaxially arranged relative to the detonator component, which release the blocking members after the ending of the impact delay.

For ammunition fired from barrelled weapons possessing a caliber of approximately 25 to 40 mm, the energy which is necessary for initiation of the broaching or piercing by means of an inertia-dependent striker member with a defined detonating delay or retardation period, is no longer available. Consequently, in view thereof, the above-mentioned patent provides for a prestressed compression spring. After the unlatching of the blocking members, this compression spring causes striking of the firing pin against the detonator cap.

The required sensitivity of the detonating system for thin-skinned or unarmored targets, flat impact angles and great combat distances, is not available because of the ratios of friction of the known prior art impact detonator. Hereby, it is governing that the blocking members which are in the shape of spheres or balls must be moved along inclined surfaces relative to the main or longitudinal axis for effecting the release of the striker for detonation, and over the relatively large contacting surfaces of the moved components.

SUMMARY OF THE INVENTION

Accordingly, it is an object of the present invention to provide an impact or percussion detonator for a mechanically highly-sensitive triggering or detonating system which, for thin-skinned or unarmored targets, flat striking angles and great combat distances, causes the initiation or triggering with adequate detonating delay or retardation periods.

The foregoing object is achieved through the intermediary of an impact detonator with a detonator cap of the type described herein, in which the detonator component is constituted of an axially movable protective sleeve, and a recess which receives the blocking members is provided in a base member fastened to a housing of the detonator at a distance in the direction towards detonating.

The striker or firing pin possesses the necessary mass or weight for implementing an inertially-dependent detonation at a high impact or striking energy. The component of the forward propelling force of the spring can hereby be neglected.

At a lower impact or striking energy, the prestressed compression spring ensures, in conjunction with low friction losses which are encountered during the movement of the striker, that the detonation by means of the striker or firing pin will be carried out with a high degree of assurance.

The detonation delay or retardation period, which is governing over the extent of the destruction of the target, can be determined in a simple manner. At a lower impact or striking energy, there is present a lengthier detonating delay period than would be for a higher striking energy. This is substantiated in that, for a lower striking energy, the protective sleeve must first be located at the rearward stop which is fixed to the detonator housing, so that the striker or firing pin can pierce the detonator cap with the necessary energy. In contrast therewith, at a higher impact or striking energy, the shorter detonating delay or retardation period is provided by the distance of the recess formed in the housing from the secured or "safe" position; in effect, the normal position of the mechanical delay arrangement.

The above-mentioned functions can be achieved with only a few movable components, and can be inexpensively manufactured, and which require only a minor assembling procedure. Moreover, also present is the necessary operational dependability.

BRIEF DESCRIPTION OF THE DRAWINGS

Reference may now be had to the following detailed description of a preferred embodiment of an impact detonator pursuant to the invention, taken in conjunction with the accompanied drawings; in which.

DETAILED DESCRIPTION

Figure 1:
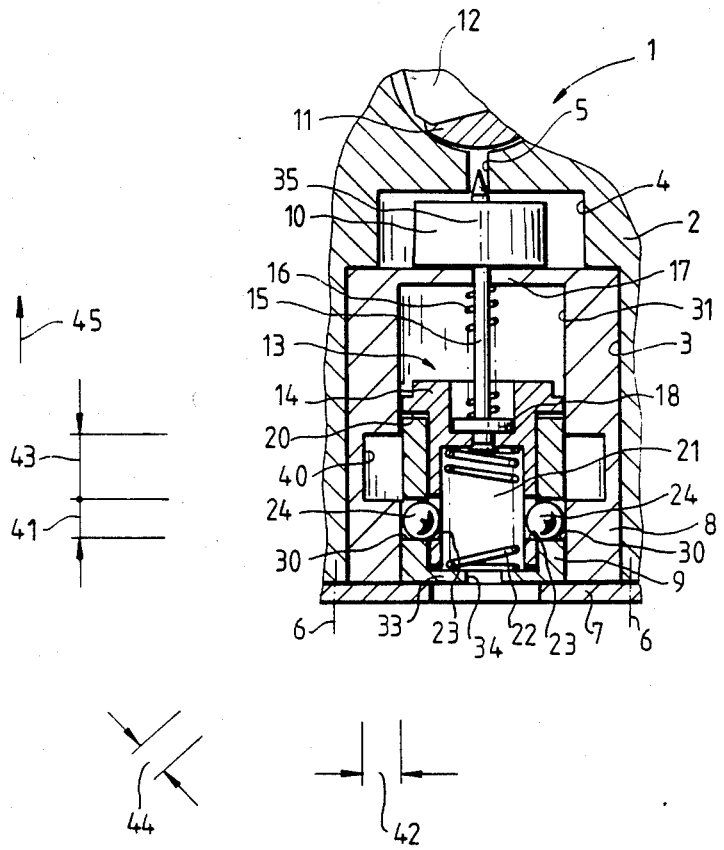
FIG. 1 illustrates a sectional view through a detonator in the secured or "safe" position.

An impact or percussion detonator 1 consists of a housing 2 with recesses 3, 4 and a bore 5, a cover 7 screw-fastened at 6, a base member 8, a protective or securing sleeve 9, a centrifugal safety 10, a rotor 11 with a detonator 12, and a striker 13.

The striker 13 is constituted of a piston sleeve 14 with a firing pin 15 riveted thereto, and a compression spring 16 which is clamped between a shoulder 17 and a plate 18.

Furthermore, the piston sleeve 14 includes a limit stop 20, a space 21 for a compression spring 22, and recesses 23 for the balls 24. The compression spring 22 positions the piston sleeve 14 against the balls 24 in the initial or basic position.

The balls 24 are arranged in cutouts or recesses 30. With respect to the outside they are bounded by a guiding wall 31, and with respect to the inside by the compression spring 22.

The protective or securing sleeve 9 is provided with a bottom wall 33 and a bore 34 in the bottom wall.

Formed in the base member 8 is an annular recess 40 at a spacing 41, and with a depth 42 and a length 43. The spacing 41 hereby corresponds somewhat with the diameter 44 of the balls 24. The depth 42 is somewhat greater than the diameter 44 of the balls. The length 43 corresponds to about twice the diameter 44 of the balls 24.

Figure 2:
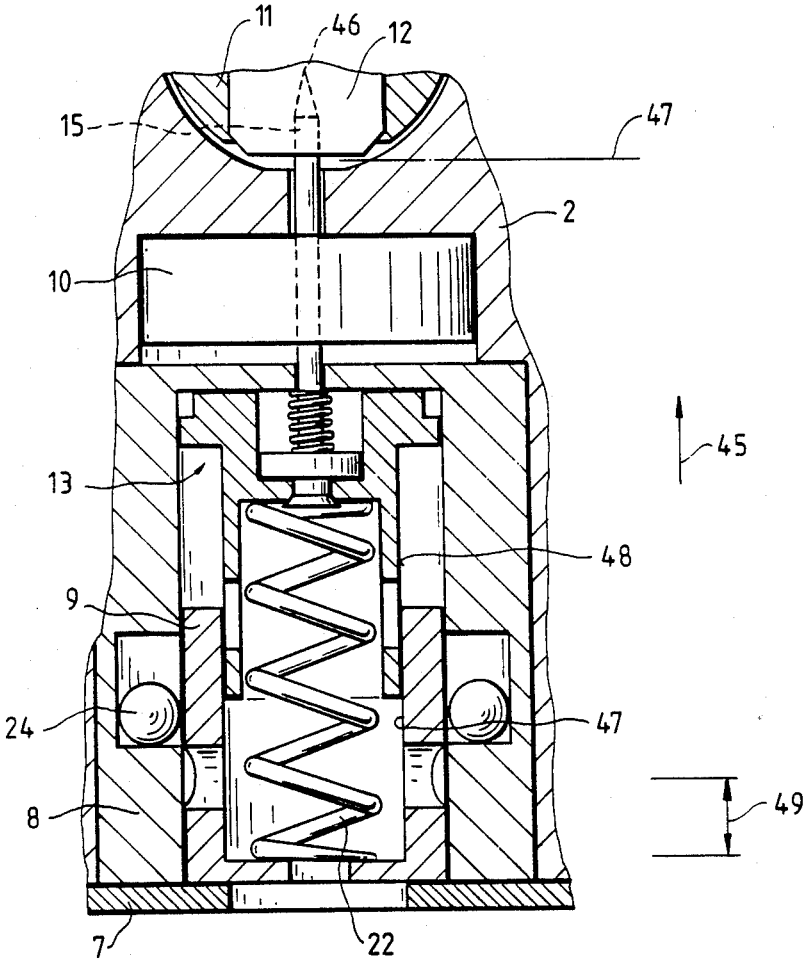
FIG. 2 illustrates the detonator, on an enlarged scale, in its triggered position.

The function of the detonator is generally as follows:

After the firing of a spin-stabilized projectile which is equipped with the detonator 1 from a weapon barrel, the rotor 11 with the detonator 12 evidences the position illustrated in FIG. 2. The centrifugal safety 10, which has releasable clamping elements (not shown) normally engaging the surface of the striker 13, has released the striker 13 responsive to radially outward displacement of the clamping elements under the centrifugal force imparted thereto by the spin of the projectile, for its axial stroke or displacement, and remains in the illustrated position.

At a large combat distance and a thin-skinned or unarmored target, after striking against the target, there is effected an axial displacement of the protective or securing sleeve 9 and of the striker 13, which are coupled to each other by means of the balls 24, along the direction of the arrow 45. The axial displacement ends, in a first phase, with the entry of the balls 24 into the recess 40. The tip 46 of the firing pin 15, at the end of the first phase, has reached the position identified by reference numeral 47.

During the second phase, the compression spring forces the protective or securing sleeve 9, opposite the direction of the arrow 45, up to contact against the cover 7 and thereafter, during the third phase, causes the forward propelling of the striker 13 up to the illustrated piercing of the detonator 12, as shown in FIG. 2.

The detonating delay or retardation period is added together from the periods of the Phases 1, 2 and 3.

Due to the relatively short guiding surfaces 47, 48 there are present only low friction losses, and thereby reproducible or precisely controllable detonating delay or retardation periods.

At short combat distances, the inertia of the striker 13 overcomes the action of the compression spring 16. As a result, there is present an extremely short detonating delay period. Controlling is generally the extent of the displacement path 49, which corresponds generally to 1.5 times the diameter of the balls 24. In this case, the length 43 of the recess 40, necessitated by the higher inertia of the striker 13 than the inertia of the securing sleeve 9, which may have a mass of up to about 30% lower than that of the striker, and affords that the balls 24 can also enter into the recess 40. The impact or percussion detonator is adapted for spin projectiles, low-spin and non-spinning projectiles. For low-spin and non-spinning projectiles there are then to be provided other suitable types of safeties for the striker, which may be responsive to other types of actuators and/or flight conditions of the projectile.

What is claimed is:

1. Impact or percussion detonator including a detonator cap; a striker actuatable by a spring force for piercing said detonator cap from the rear end of said detonator; a mechanical delay arrangement including blocking members which, in the blocking position of said members are located, on the one side, in recesses formed in said striker and, on the other side, in recesses formed in a detonator component, said detonator component being constituted of an axially-movable securing sleeve; and a base member secured to a housing of said detonator having a cutout for receiving said blocking members at a distance towards the detonating direction.

2. Impact detonator as claimed in claim 1, wherein the distance corresponds to substantially the diameter of the blocking members.

3. Impact detonator as claimed in claim 1, wherein said securing sleeve has a mass approximately 30% lower than that of the striker.

4. Impact detonator as claimed in claim 1, wherein said securing sleeve is cup-shaped; a piston sleeve integrally connected with said striker being axially displaceable within said securing sleeve, said blocking members comprising balls for latching said piston sleeve with said securing sleeve, such that upon striking a target, the securing sleeve with the striker, the balls and a compression spring implement an axial displacement during a first phase, thereafter an unlatching is effected, during a second phase, said compression spring telescopes the securing sleeve and the piston sleeve apart to such an extent until the securing sleeve contacts a cover on the detonator housing, and during a third phase, the piston sleeve is propelled forwardly thereby up to piercing the detonator.

5. Impact detonator as claimed in claim 4, wherein the interior of said cup-shaped securing sleeve and the piston sleeve displaceable therein forms a chamber-like space therebetween, and a prestressed compression spring is arranged in said space.

6. Impact detonator as claimed in claim 4, wherein the cutout in the base member assesses a depth somewhat greater than the diameter of the balls constituting the blocking members.

7. Impact detonator as claimed in claim 4, wherein the cutout in the base member has a length which is approximately twice the diameter of the balls constituting the blocking members.

* * * * *